US009646555B2

(12) United States Patent
Hwang et al.

(10) Patent No.: US 9,646,555 B2
(45) Date of Patent: May 9, 2017

(54) DISPLAY DEVICE IN WHICH FREQUENCY OF VERTICAL SYNC START SIGNAL IS SELECTIVELY CHANGED AND METHOD OF DRIVING THE SAME

(71) Applicant: SAMSUNG DISPLAY CO., LTD., Yongin, Gyeongi-Do (KR)

(72) Inventors: Jun-Ho Hwang, Asan-si (KR); Heebum Park, Seongnam-si (KR); Kihyun Pyun, Gwangmyeong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 43 days.

(21) Appl. No.: 14/457,551

(22) Filed: Aug. 12, 2014

(65) Prior Publication Data

US 2015/0206489 A1 Jul. 23, 2015

(30) Foreign Application Priority Data

Jan. 20, 2014 (KR) ..... 10-2014-0006822

(51) Int. Cl.
*G09G 3/36* (2006.01)

(52) U.S. Cl.
CPC ..... *G09G 3/3648* (2013.01); *G09G 3/3607* (2013.01); *G09G 2230/00* (2013.01); *G09G 2300/0408* (2013.01); *G09G 2320/0209* (2013.01); *G09G 2320/0233* (2013.01); *G09G 2320/0295* (2013.01)

(58) Field of Classification Search
CPC ..... G09G 3/3648; G09G 3/3607; G09G 2230/00; G09G 2300/0408; G09G 2320/0209; G09G 2320/0233; G09G 2320/0295
See application file for complete search history.

(56) References Cited

U.S. PATENT DOCUMENTS 6,888,517 B2 5/2005 Ikemoto
7,148,870 B2 * 12/2006 Tada ..... G09G 3/3614 345/90
8,044,910 B2 10/2011 Song et al.
2006/0114275 A1 6/2006 Kim et al.
(Continued)

FOREIGN PATENT DOCUMENTS

JP 2004-163829 A 6/2004
KR 1020050056796 A 6/2005
(Continued)

*Primary Examiner* — Kwang-Su Yang
(74) *Attorney, Agent, or Firm* — Cantor Colburn LLP

(57) ABSTRACT

A display device includes: a display panel including gate lines, a data lines crossing the gate lines, and pixels connected to the data lines and the gate lines; a data driver configured to drive the data lines; a gate driver configured to drive the gate lines in synchronization with a vertical sync start signal; and a timing controller configured to control the data driver and the gate driver in response to an image signal and a control signal inputted thereto from an outside, where the timing controller outputs the vertical sync start signal to the gate driver, and changes a frequency of the vertical sync start signal when an image signal of a current frame is identical to an image signal shifted from an image signal of a previous frame in a first direction.

19 Claims, 12 Drawing Sheets

(56) References Cited

U.S. PATENT DOCUMENTS

| | | | | |
|---|---|---|---|---|
| 2007/0035650 | A1* | 2/2007 | Suzuki | H04N 5/232 348/312 |
| 2007/0103424 | A1* | 5/2007 | Huang | G09G 3/342 345/102 |
| 2008/0111931 | A1 | 5/2008 | Zhou et al. | |
| 2009/0096769 | A1* | 4/2009 | Kim | G09G 3/2096 345/204 |
| 2010/0302438 | A1* | 12/2010 | Fujisawa | H04N 7/014 348/441 |
| 2011/0128287 | A1* | 6/2011 | Lee | H04N 13/0438 345/426 |
| 2012/0162159 | A1 | 6/2012 | Kim et al. | |
| 2013/0135330 | A1 | 5/2013 | Choi et al. | |
| 2013/0148056 | A1 | 6/2013 | Hineno et al. | |
| 2013/0215090 | A1* | 8/2013 | Kim | G09G 3/3648 345/204 |

FOREIGN PATENT DOCUMENTS

| | | | | | |
|---|---|---|---|---|---|
| KR | 1020060018393 | A | | 3/2006 | |
| KR | 1020080048655 | A | | 6/2008 | |
| KR | 1020080050032 | A | * | 6/2008 | G09G 3/3648 |
| KR | 1020080050032 | A | | 6/2008 | |
| KR | 1020080079827 | A | | 9/2008 | |

* cited by examiner

DISPLAY DEVICE IN WHICH FREQUENCY OF VERTICAL SYNC START SIGNAL IS SELECTIVELY CHANGED AND METHOD OF DRIVING THE SAME

This application claims priority to Korean Patent Application No. 10-2014-0006822, filed on Jan. 20, 2014, and all the benefits accruing therefrom under 35 U.S.C. §119, the content of which in its entirety is herein incorporated by reference.

BACKGROUND

1. Field

Exemplary embodiments of the invention disclosed herein relate to a display device and a method of driving the display device.

2. Description of the Related Art

In general, a display device includes a display panel for displaying an image, and data and gate drivers for driving the display panel. The display panel includes a plurality of gate lines, a plurality of data lines, and a plurality of pixels. Each pixel includes a thin film transistor, a liquid crystal capacitor and a storage capacitor. The data driver outputs grayscale voltage to the data lines, and the gate driver outputs gate drive signal for driving the gate lines.

Such a display device may display an image by applying data voltage corresponding to a display image to a source electrode after applying gate-on voltage to a gate electrode of a thin film transistor connected to a gate line to be displayed. As the thin film transistor is turned on, a data voltage applied to the liquid capacitor and the storage capacitor are maintained for a predetermined time after the thin film transistor is turned off. However, due to a parasite capacitance between the gate electrode and the drain electrode of the thin film transistor resulting from manufacturing processes of the display panel, an actual grayscale voltage applied to the liquid crystal capacitor and the storage capacitor may be distorted. That is, there may be a difference between a grayscale voltage outputted from the data driver and an actual grayscale voltage applied to the storage capacitor. Such a distorted voltage is typically called as a kickback voltage. As the kickback voltage becomes greater and the deviation between kickback voltages between thin film transistors in the display panel becomes greater, the quality of an image displayed on the display panel is deteriorated, e.g., a brightness difference may be noticed in a specific image pattern due to kickback voltage.

SUMMARY

Exemplary embodiments of the invention provide a display device with improved display quality.

Exemplary embodiments of the invention provide a method of driving a display device to improve display quality.

Exemplary embodiments of the invention provide a display device including: a display panel including a plurality of gate lines, a plurality of data lines crossing the plurality of gate lines, and a plurality of pixels connected to the plurality of data lines and the plurality of gate lines; a data driver configured to drive the plurality of data lines; a gate driver configured to drive the plurality of gate lines in synchronization with a vertical sync start signal; and a timing controller configured to control the data driver and the gate driver in response to an image signal and a control signal inputted thereto from an outside, where the timing controller outputs the vertical sync start signal to the gate driver, and changes a frequency of the vertical sync start signal when an image signal of a current frame is identical to an image signal shifted from an image signal of a previous frame in a first direction.

In an exemplary embodiment, the timing controller may further output a data enable signal to the gate driver in synchronization with the vertical sync start signal, where the data enable signal may include an active interval and a blank interval.

In an exemplary embodiment, the blank interval of the data enable signal may be substantially inversely proportional to the frequency of the vertical sync start signal.

In an exemplary embodiment, the timing controller may further output a parallel sync start signal to the data driver in synchronization with the data enable signal.

In an exemplary embodiment, the timing controller may change a frequency of the vertical sync start signal when the image signal of the current frame is an image shifted from the image signal of the previous frame by H pixel(s) in the first direction, where H is a positive integer.

In an exemplary embodiment, when the frequency of the vertical sync start signal corresponding to the control signal is about 60 hertz (Hz), H may be 1.

In an exemplary embodiment, when the frequency of the vertical sync start signal corresponding to the control signal is about 120 Hz, H may be 2.

In an exemplary embodiment, the timing controller may include: an image processing unit configured to convert the image signal into a data signal which is applied to the data driver; a buffer configured to store the image signal and to output the image signal of the previous frame; a test region determination unit configured to receive the control signal, where the test region determination unit may determine whether image signal is an image signal to be disposed in a test region of the display panel, and output an enable signal based on a determination result; and a control signal generation unit configured to receive the image signal as the image signal of the current frame, where the control signal generation unit may receive the image signal of the previous frame from the buffer, and output the vertical sync start signal based on the control signal and the enable signal.

In an exemplary embodiment, the control signal generation unit may include: a comparator configured to compare the image signal of the current frame with the image signal shifted from the image signal of the previous frame in the first direction and to output a frequency change signal based on a comparison result; and a control signal generation unit configured to output the vertical sync start signal based on the frequency change signal and the control signal.

In an exemplary embodiment, the control signal generation unit may further output a data enable signal to the gate driver in synchronization with the vertical sync start signal, where the data enable signal may include an active interval and a blank interval.

In an exemplary embodiment, the blank interval of the data enable signal may be substantially inversely proportional to the vertical sync start signal.

In an exemplary embodiment, the control signal generation unit may further output a parallel sync start signal to the data driver in synchronization with the data enable signal.

In an exemplary embodiment, the control signal generation unit may change the frequency of the vertical sync start signal when the image signal of the current frame is an image shifted from the image signal of the previous frame by H pixel(s) in the first direction, where H is a positive integer.

In an exemplary embodiment, when the frequency of the vertical sync start signal corresponding to the control signal is about 60 Hz, H may be 1.

In an exemplary embodiment of the invention, a method of driving a display device includes: receiving an image signal of a current frame and a control signal by a timing controller of the display device; storing an image signal of a previous frame in a buffer of the timing controller; generating a vertical sync start signal from the timing controller based on the control signal; changing a frequency of the vertical sync start signal when the image signal of the current frame is identical to an image signal shifted from the image signal of the previous frame in a first direction; and providing a data signal corresponding to the image signal of the current frame to a display panel of the display device in synchronization with the vertical sync start signal.

In an exemplary embodiment, the methods may further include generating a data enable signal including an active interval and a blank interval in synchronization with the vertical sync start signal.

In an exemplary embodiment, the blank interval of the data enable signal may be substantially inversely proportional to the frequency of the vertical sync start signal.

In an exemplary embodiment, the changing the frequency of the vertical sync start signal may include changing the frequency of the vertical sync start signal when the image signal of the current frame is an image shifted from the image signal of the previous frame by H pixel(s) in the first direction, where H is a positive integer.

In an exemplary embodiment, the methods may further include activating an enable signal when the image signal of the current frame is an image signal to be displayed in a test region of the display panel, where the changing the frequency of the vertical sync start signal may be performed when the enable signal is in an active state.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION

Figure 1:
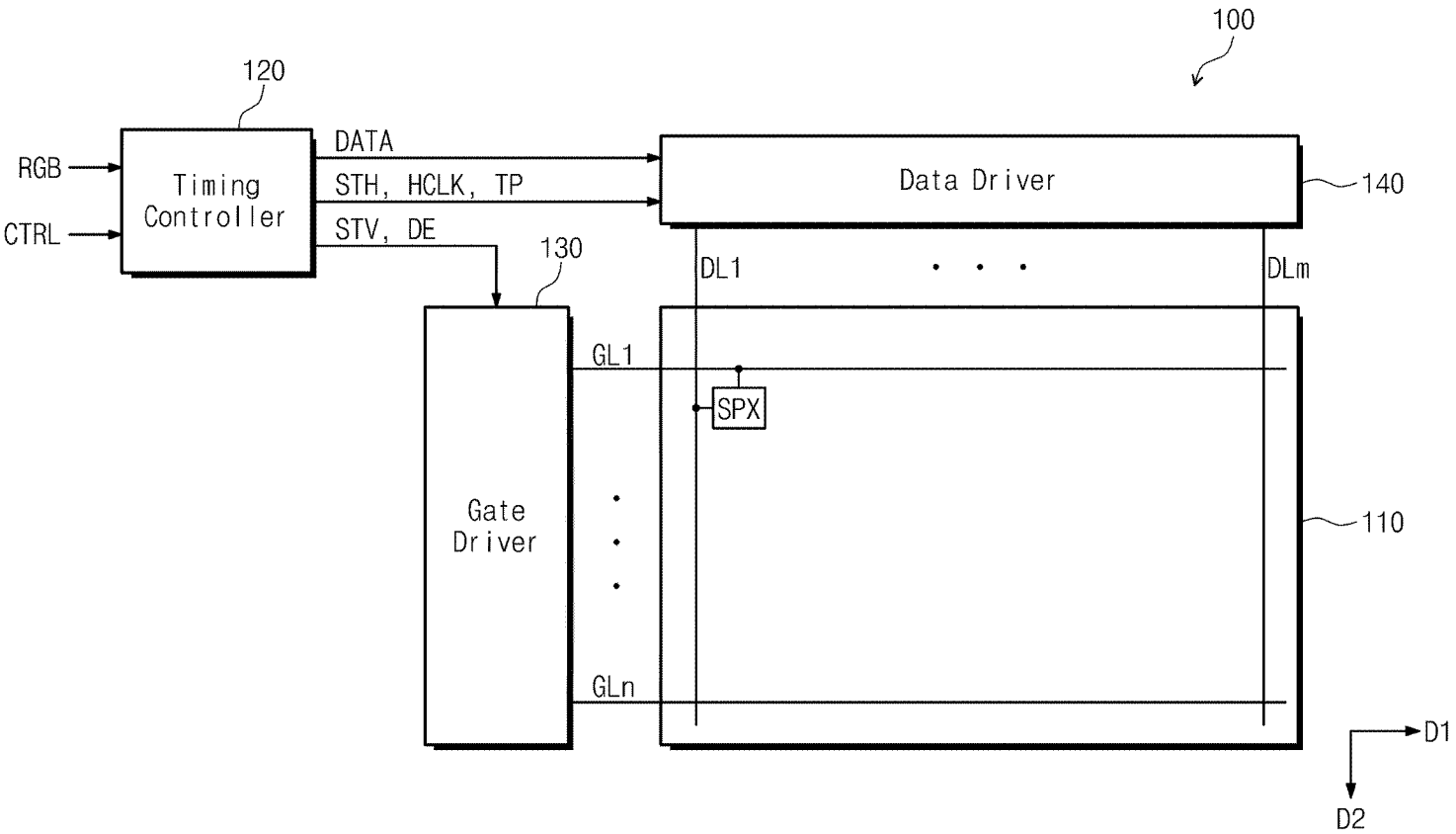
FIG. 1 is a block diagram illustrating an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating an exemplary embodiment of a display device according to the invention.

Referring to FIG. 1, an exemplary embodiment of the display device 100 includes a display panel 110, a timing controller 120, a gate driver 130 and a data driver 140.

The display device 100 may be one of a liquid crystal display ("LCD") device, a plasma panel display ("PDP") device, an organic light emitting diode ("OLED") display device, and a field emission display ("FED") device, for example.

The display panel 110 includes a plurality of gate lines, e.g., first to n-the gate lines GL1 to GLn, extending substantially in a first direction D1, a plurality of data lines, e.g., first to m-th data lines DL1 to DLm, extending substantially in a second direction D2, and a plurality of sub pixels SPX connected to the gate lines GL1 to GLn and the data lines DL1 to DLm. Here, n and m are natural numbers. The plurality of data lines DL1 to DLm and the plurality of gate lines GL1 to GLn are insulated from each other. Each sub pixel SPX includes a switching transistor connected to a corresponding data line and a corresponding gate line, a liquid crystal capacitor connected to the transistor, and a storage capacitor.

The timing controller 120 receives an image signal RGB from the outside and a control signal CTRL for controlling displaying the image signal RGB. In one exemplary embodiment, for example, the control signal CTRL includes a vertical sync signal, a horizontal sync signal, a main clock signal, and a data enable signal. The timing controller 120 provides a data signal DATA, which is generated based on the image signal RGB, to the data driver 140. The data signal DATA may be generated by processing an image signal RGB to correspond to an operating condition of the display panel 110. The timing controller 120 provides a horizontal sync start signal STH, a clock signal HCLK, and a line latch signal TP to the data driver 140 and provides a vertical sync start signal STV and an output enable signal DE to the gate driver 130 based on the control signal CTRL.

The timing controller 120 changes a frequency of the vertical sync start signal STV when the image signal RGB of a current frame is identical to an image signal shifted from the image signal RGB of a previous frame in the first direction D1. The output enable signal DE includes an active interval at which an image is displayed on the display panel 110 and a blank interval at which no image is displayed. In an exemplary embodiment, the timing controller 120 adjusts a blank interval of the output enable signal DE to change a frequency of the vertical sync start signal STV. In such an embodiment, the timing controller 120 generates a parallel start signal STH in synchronization with the output enable signal DE. The vertical sync start signal STV and the output enable signal DE generated from the timing controller 120 are described later in greater detail.

The gate driver 130 drives the plurality of gate lines GL1 to GLn based on the vertical sync start signal STV and the output enable signal DE generated from the timing controller 120.

In an exemplary embodiment, the gate driver 130 may be implemented with an amorphous silicon gate ("ASG") using an amorphous-silicon switching transistor (e.g., an amorphous silicon thin film transistor ("a-Si TFT")) and a circuit using an oxide semiconductor, a crystalline semiconductor and a polycrystalline semiconductor, and the gate driver 130 may be disposed on a substrate of the display panel 110. In an alternative exemplary embodiment, the gate driver 130 may be implemented with a gate drive integrated circuit ("IC") and may be connected to a side of the display panel.

The data driver 140 drives the plurality of data lines DL1 to DLn based on a data signal DATA, a horizontal sync start signal STH, a clock signal HCLK and a line latch signal TP generated from the timing controller 120.

Figure 2:
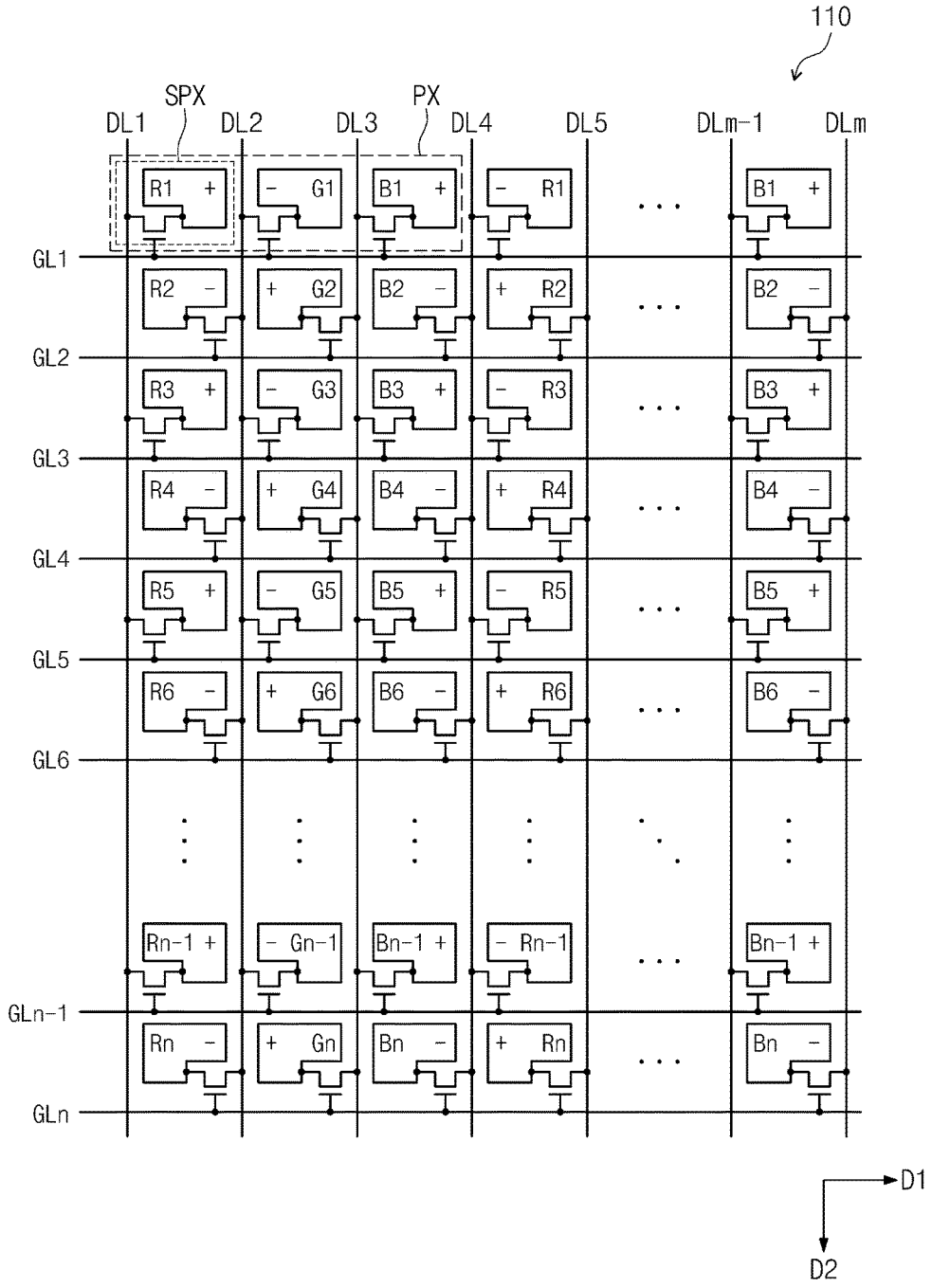
FIG. 2 is a view illustrating an arrangement of an exemplary embodiment of sub pixels in the display panel of FIG. 1.

FIG. 2 is a view illustrating an arrangement of an exemplary embodiment of sub pixels in the display panel of FIG. 1.

Referring to FIG. 2, each sub pixel SPX in the display panel 110 includes one of pixel electrodes R, G and B corresponding to red, green and blue, and a switching transistor. Herein, a sub pixel including a pixel electrode corresponding to red is referred to as a red sub pixel, a sub pixel including a pixel electrode corresponding to green is referred to as a green sub pixel, and a sub pixel including a pixel electrode corresponding to blue is referred to as a blue sub pixel. A pixel PX may be defined by a red sub pixel, a green sub pixel, and a blue sub pixel, which are sequentially arranged in the first direction D1.

A switching transistor in a sub pixel SPX is connected to a corresponding data line and a corresponding gate line. The red sub pixel Ri, the green sub pixel Gi, and the blue sub pixel Bi are sequentially arranged in an extension direction of a gate line, i.e., the first direction D1, and pixels of the same color may be sequentially arranged in an extension direction of a data line, i.e., a second direction D2 (here, i=1, 2, . . . , n). In one exemplary embodiment, for example, red sub pixels R1-Rn are arranged at the right of the first data line DL1, green sub pixels G1-Gn are arranged between the second and third data lines DL2 and DL3, and blue sub pixels B1-Bn are arranged between the third and fourth data lines DL3 and DL4. In such an embodiment, the red sub pixel Ri, the green sub pixel Gi and the blue sub pixel Bi are sequentially arranged in the first direction D1, i.e., an extension direction of an i-th gate line, but not being limited thereto. In an alternative exemplary embodiment, an arrangement order of pixels in the first direction D1 may be variously modified, for example, (Ri, Bi, Gi), (Gi, Bi, Ri), (Gi, Ri, Bi), (Bi, Ri, Gi) or (Bi, Gi, Ri).

Referring to FIG. 2, some of the red sub pixels R1 to Rn, the green sub pixels G1 to Gn, and the blue sub pixels B1 to Bn are connected to a left adjacent data line, and the remaining thereof are connected to a right adjacent data line. In an exemplary embodiment, as shown in FIG. 2, switching transistors in odd-numbered red sub pixels R1, R3, . . . , Rn-1, odd-numbered green sub pixels G1, G3, . . . , Gn-1, and odd-numbered blue sub pixels B1, B3, . . . , Bn-1, which are connected to odd-numbered gate lines GL1, GL3, . . . , GLn-1, are connected to the left adjacent data lines DL1 to DLn, and switching transistors in even-numbered red sub pixels R2, R4, . . . , Rn, even-numbered green sub pixels G2, G4, . . . , Gn, and even-numbered blue sub pixels B2, B4, . . . , Bn, which are connected to even-numbered gate lines GL2, GL4, . . . , GLn, are connected to right adjacent data lines DL1 to DLn. Such a connection structure may be referred to as a staggered structure in which the red sub pixels R1 to Rn, the green sub pixels G1 to Gn, and the blue sub pixels B1 to Bn are alternately connected to the left and right adjacent data lines at each sub pixel.

In an exemplary embodiment, the data lines DL1 to DLm may be driven through a column inversion method. In the column inversion method, polarities of grayscale voltages provided to adjacent data lines based on common voltage VCOM are complementary to each other or opposite to each other.

In such an embodiment, where sub pixels and data lines are connected as described above, even when the data lines are driven by the data driver through the column inversion method, an inversion displayed on a screen, i.e., an apparent inversion, is identical to a dot inversion. That is, grayscale voltages provided to adjacent sub pixels have polarities complementary to each other. If the apparent inversion becomes the dot inversion, brightness difference due to a kick-back voltage occurring when grayscale is a positive polarity and a negative polarity is dispersed such that vertical flicker is reduced.

Figure 3:
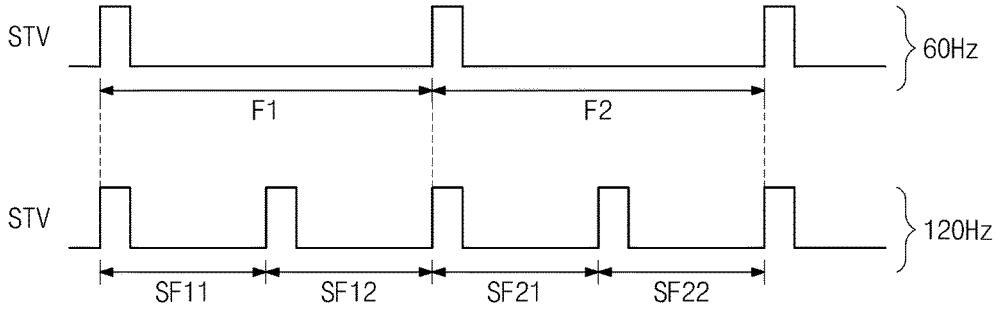
FIG. 3 is a timing diagram illustrating an exemplary embodiment of a vertical sync start signal generated from the timing controller of FIG. 1.

FIG. 3 is a timing diagram illustrating an exemplary embodiment of a vertical sync start signal generated from the timing controller of FIG. 1.

Referring to FIGS. 1 and 3, when the display device 100 operates at about 60 hertz (Hz), a frequency of a vertical sync start signal STV is about 60 Hz. That is, the vertical sync signal STV includes one pulse in each of a first frame F1 and a second frame F2.

When the display device 100 operates at about 120 Hz, a frequency of a vertical sync start signal STV is about 120 Hz. That is, the vertical sync signal STV includes two pulses in each of the first frame F1 and the second frame F2. When the display device 100 operates at about 120 Hz, the first frame F1 includes a first sub frame SF11 and a second sub frame SF12, and the second frame F2 includes a first sub frame SF21 and a second sub frame SF22.

Figure 4:
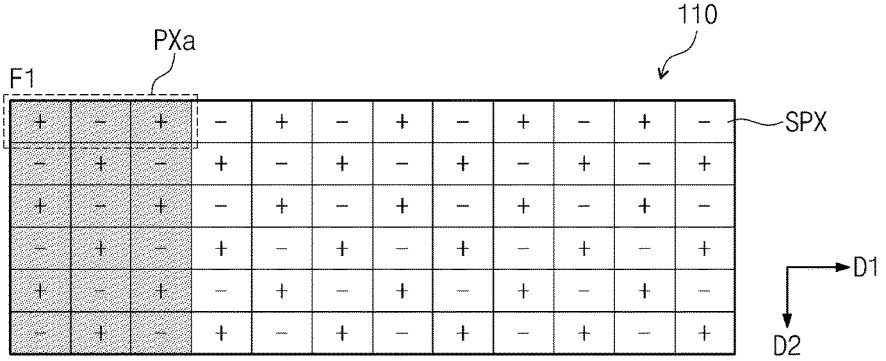
FIG. 4 is a view illustrating an image displayed on an exemplary embodiment of a display panel during a first frame of FIG. 3 when a display device operates at about 60 hertz (Hz)
Figure 5:
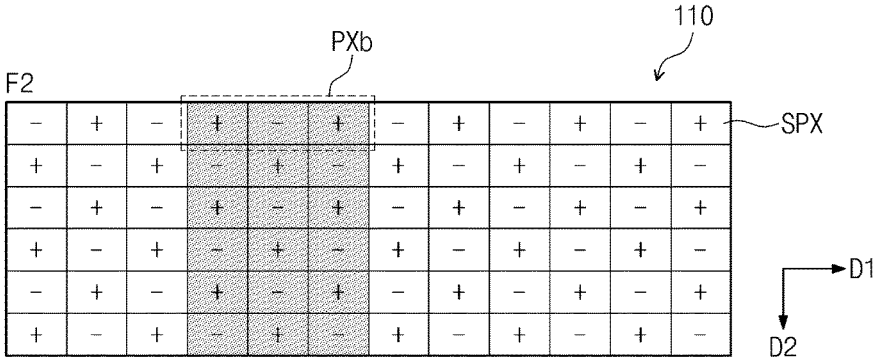
FIG. 5 is a view illustrating an image displayed on an exemplary embodiment of a display panel during a second frame of FIG. 3 when a display device operates at about 60 Hz.

FIG. 4 is a view illustrating an image displayed on an exemplary embodiment of a display panel during the first frame of FIG. 3 when the display device operates at about 60 Hz. FIG. 5 is a view illustrating an image displayed on an exemplary embodiment of a display panel during the second frame of FIG. 3 when the display device operates at about 60 Hz. The display panel shown in FIGS. 4 and 5 has the staggered structure of FIG. 2.

Referring to FIGS. 1 and 3 to 5, the display panel 110 includes 4×6 pixels, but not being limited thereto. In FIGS. 4 and 5, only 4×6 pixels in the display panel 110 are shown for convenience of illustration, and the number of pixels arranged in the display panel 110 may be determined based on a resolution thereof, e.g., one of 1920×1080, 2560×1440 and 3840×2160.

An image displayed on a first pixel PXa in the first frame F1 may move to a second pixel PXb in the second frame F2. That is, an image displayed on the display panel 110 in the first frame F1 moves by one pixel in the first direction D1 in the second frame F2 subsequent to the first frame F1.

If the display panel 110 is driven through a column inversion method, a red sub pixel, a green sub pixel and a blue sub pixel in the first pixel PXa may be driven in positive polarity (+), negative polarity (−) and positive polarity (+), respectively, in the first frame F1 as shown in FIG. 4, and a red sub pixel, a green sub pixel, and a blue sub pixel in the second pixel PXb may be driven in positive polarity (+), negative polarity (−) and positive polarity (+), respectively, in the second frame F2 as shown in FIG. 5.

When an image displayed on the first pixel PXa in the first frame F1 moves to the second pixel PXb in the second frame F2, the same image signal is repeatedly driven in positive polarity (+), negative polarity (−) and positive polarity (+). That is, even when the display panel 110 is driven through a column inversion method, an image displayed on the display panel 110 is displayed in a fixed polarity.

Figure 6:
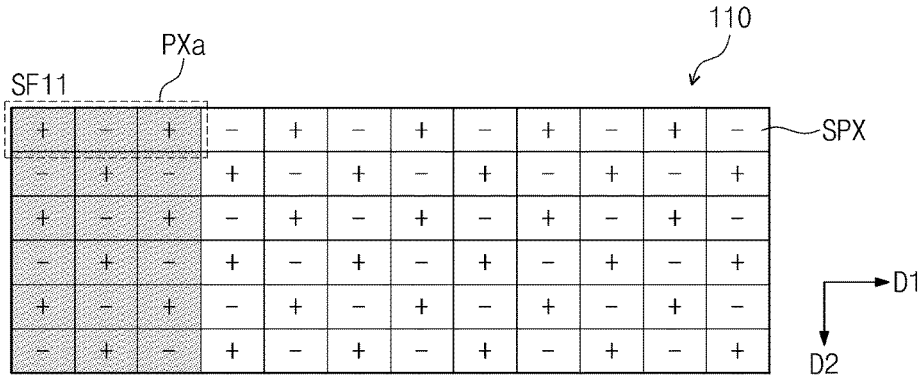
FIG. 6 is a view illustrating an image displayed on an exemplary embodiment of a display panel during a first sub frame in the first frame of FIG. 3 when the display device operates at about 120 Hz.
Figure 7:
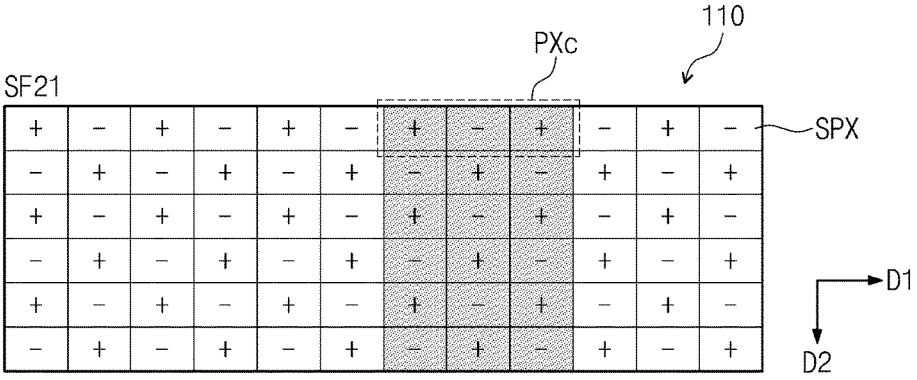
FIG. 7 is a view illustrating an image displayed on an exemplary embodiment of a display panel during a first sub frame in the second frame of FIG. 3 when the display device operates at about 120 Hz.

FIG. 6 is a view illustrating an image displayed on an exemplary embodiment of a display panel during a first sub frame in the first frame of FIG. 3 when the display device operates at about 120 Hz. FIG. 7 is a view illustrating an image displayed on an exemplary embodiment of a display panel during a first sub frame in the second frame of FIG. 3 when the display device operates at about 120 Hz. The display panel shown in FIGS. 6 and 7 has the staggered structure of FIG. 2.

Referring to FIGS. 1, 3, 6, and 7, the display panel 110 includes 4×6 pixels, but not being limited thereto. In FIGS. 6 and 7, only 4×6 pixels in the display panel 110 are shown for convenience of illustration, and the number of pixels arranged in the display panel 110 may be determined based on a resolution thereof, e.g., one of 1920×1080, 2560×1440, and 3840×2160.

An image displayed on a first pixel PXa in the first sub frame SF11 in the first frame F1 moves to a third pixel PXc in a first sub frame SF21 in the second frame F2. An image displayed on the display panel 110 in the first sub frame SF11 in the first frame F1 moves by two pixels in the first direction D1 in the first sub frame SF21 in the second frame F2.

If the display panel 110 is driven through a column inversion method, a red sub pixel, a green sub pixel and a blue sub pixel in the first pixel PXa may be driven in positive polarity (+), negative polarity (−) and positive polarity (+), respectively, in the first sub frame SF11 in the first frame F1 as shown in FIG. 6, and a red sub pixel, a green sub pixel, and a blue sub pixel in the second pixel PXb may be driven in positive polarity (+), negative polarity (−) and positive polarity (+), respectively, in the first sub frame SF21 in the second frame F2 as shown in FIG. 7.

When an image displayed on the first pixel PXa in the first sub frame SF11 in the first frame F1 moves to the third pixel PXc in the first sub frame SF21 in the second frame F2, the same image signal is repeatedly driven in positive polarity (+), negative polarity (−) and positive polarity (+). That is, even when the display panel 110 is driven through a column inversion method, an image displayed on the display panel 110 is displayed in a fixed polarity.

Figure 8:
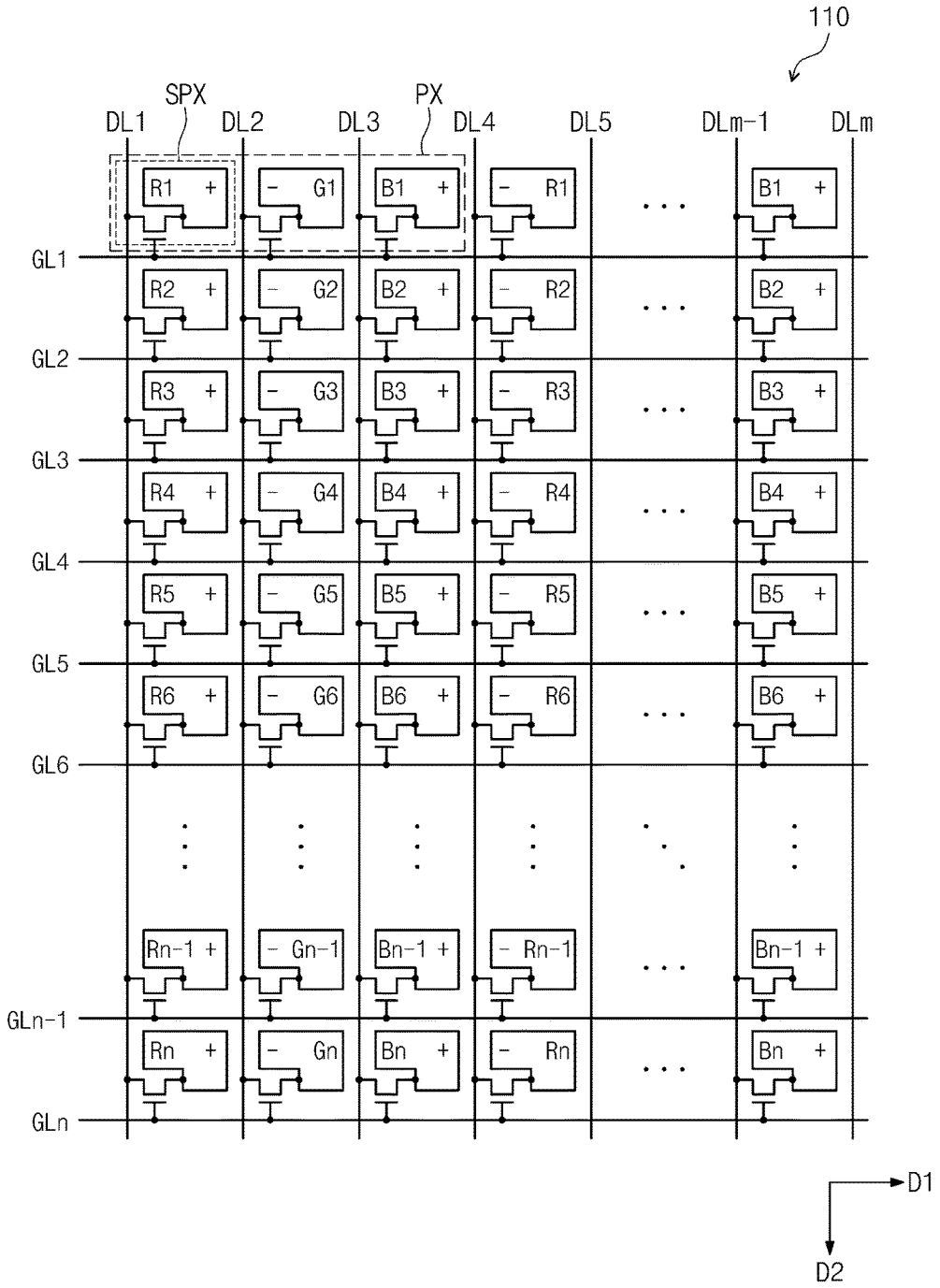
FIG. 8 is a view illustrating an arrangement of an exemplary embodiment of sub pixels in the display panel of FIG. 1.

FIG. 8 is a view illustrating an arrangement of an exemplary embodiment of the sub pixels in the display panel of FIG. 1.

Referring to FIG. 8, each sub pixel SPX in the display panel 110 includes one of pixel electrodes R, G, and B corresponding to red, green and blue and a switching transistor. Herein, a sub pixel including a pixel electrode corresponding to red is referred to as a red sub pixel, a sub pixel including a pixel electrode corresponding to green is referred to as a green sub pixel, and a sub pixel including a pixel electrode corresponding to blue is referred to as a blue sub pixel. One pixel PX may be defined by a red sub pixel, a green sub pixel and a blue sub pixel, which are sequentially arranged in the first direction D1.

The red sub pixel Ri, the green sub pixel Gi and the blue sub pixel Bi are sequentially arranged in an extension direction of a gate line, i.e., the first direction D1, and pixels of the same color may be sequentially arranged in an extension direction of a data line, i.e., a second direction D2 (i=1, 2, . . . , n). In one exemplary embodiment, for example, red sub pixels R1-Rn are arranged at the right of the first data line DL1, green sub pixels G1-Gn are arranged between the second and third data lines DL2 and DL3, and blue sub pixels B1-Bn are arranged between the third and fourth data lines DL3 and DL4. In an exemplary embodiment, the red sub pixel Ri, the green sub pixel Gi and the blue sub pixel Bi are sequentially arranged in the first direction D1, i.e., an extension direction of an i-th gate line, as shown in FIG. 8, but not being limited thereto. In an alternative exemplary embodiment, an arrangement order of pixels may be variously modified, for example, (Ri, Bi, Gi), (Gi, Bi, Ri), (Gi, Ri, Bi), (Bi, Ri, Gi) or (Bi, Gi, Ri).

Referring to FIG. 8, the red sub pixels R1 to Rn, the green sub pixels G1 to Gn, and the blue sub pixels B1 to Bn are connected to a left adjacent data line. Such a connection structure may be referred to as a non-staggered structure.

In such an embodiment, the data lines DL1-DLm may be driven through a column inversion method. In the column inversion method, the polarity of a grayscale voltage applied to a same data line based on common voltage VCOM are the same and the polarities of grayscale voltages provided to adjacent data lines based on common voltage VCOM are complementary to or opposite to each other. That is, grayscale voltages provided to adjacent sub pixels in the first direction D1 have polarities complementary to each other.

Figure 9:
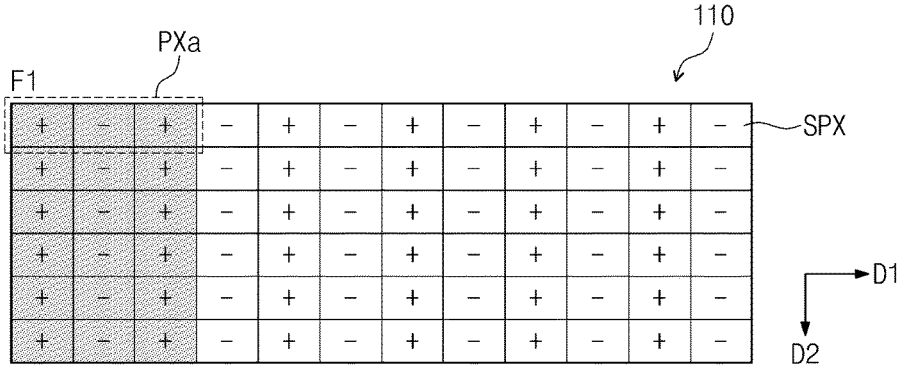
FIG. 9 is a view illustrating an image displayed on an exemplary embodiment of a display panel during the first frame of FIG. 3 when a display device operates at about 60 Hz.
Figure 10:
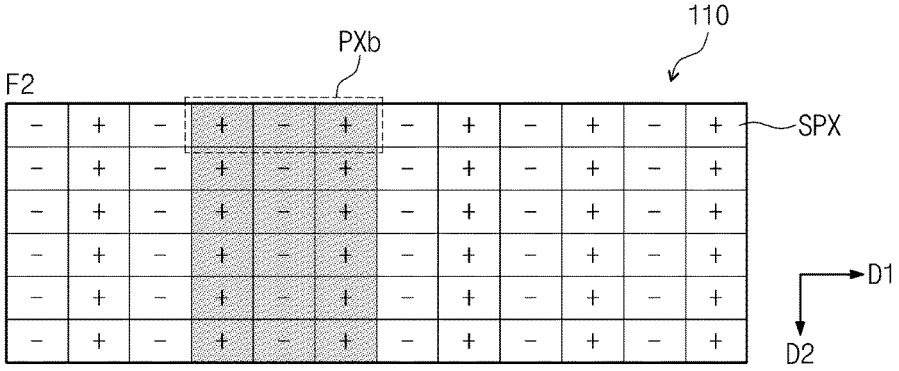
FIG. 10 is a view illustrating an image displayed on an exemplary embodiment of a display panel during the second frame of FIG. 3 when the display device operates at about 60 Hz.

FIG. 9 is a view illustrating an image displayed on an exemplary embodiment of a display panel during the first frame of FIG. 3 when the display device operates at about 60 Hz. FIG. 10 is a view illustrating an image displayed on an exemplary embodiment of a display panel during the second frame of FIG. 3 when the display device operates at about 60 Hz. The display panel shown in FIGS. 9 and 10 has the non-staggered structure of FIG. 8.

Referring to FIGS. 1, 3, 9 and 10, the display panel 110 includes 4×6 pixels, but not being limited thereto. In FIGS. 9 and 10, only 4×6 pixels in the display panel 110 are shown for convenience of illustration, and the number of pixels arranged in the display panel 110 may be determined based on a resolution thereof, e.g., one of 1920×1080, 2560×1440, and 3840×2160 according to resolution.

An image displayed on a first pixel PXa in the first frame F1 moves to a second pixel PXb in the second frame F2. That is, an image displayed on the display panel 110 in the first frame F1 moves by one pixel in the first direction D1 in the second frame F2 subsequent to the first frame F1.

If the display panel 110 is driven through a column inversion method, a red sub pixel, a green sub pixel and a blue sub pixel in the first pixel PXa are driven in positive polarity (+), negative polarity (−), and positive polarity (+), respectively, in the first frame F1 as shown in FIG. 9, and a red sub pixel, a green sub pixel and a blue sub pixel in the second pixel PXb are driven in positive polarity (+), negative polarity (−), and positive polarity (+), respectively, in the second frame F2 as shown in FIG. 10.

When an image displayed on the first pixel PXa in the first frame F1 moves to the second pixel PXb in the second frame F2, the same image signal may be repeatedly driven in positive polarity (+), negative polarity (−) and positive polarity (+) as shown in FIGS. 9 and 10. That is, even when the display panel 110 is driven through a column inversion method, an image displayed on the display panel 110 is displayed in a fixed polarity.

Figure 11:
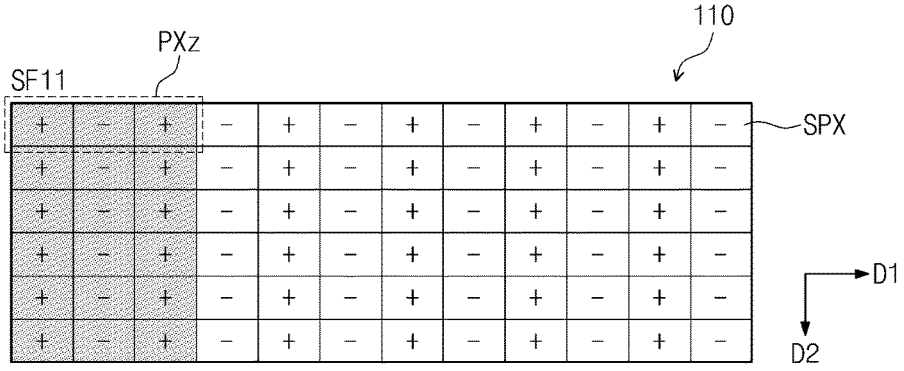
FIG. 11 is a view illustrating an image displayed on an exemplary embodiment of a display panel during a first sub frame in the first frame of FIG. 3 when the display device operates at about 120 Hz.
Figure 12:
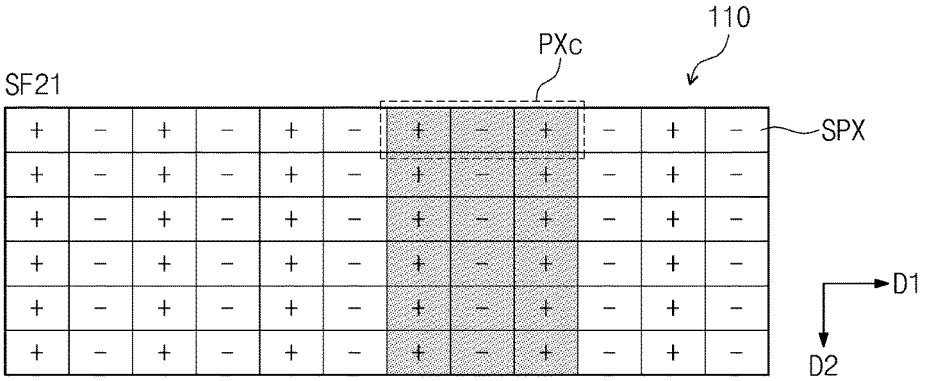
FIG. 12 is a view illustrating an image displayed on an exemplary embodiment of a display panel during a first sub frame in the second frame of FIG. 3 when the display device operates at about 120 Hz.

FIG. 11 is a view illustrating an image displayed on an exemplary embodiment of a display panel during the first sub frame in the first frame of FIG. 3 when the display device operates at about 120 Hz. FIG. 12 is a view illustrating an image displayed on an exemplary embodiment of a display panel during the first sub frame in the second frame of FIG. 3 when the display device operates at about 120 Hz. The display panel shown in FIGS. 11 and 12 has the non-staggered structure of FIG. 8.

Referring to FIGS. 1, 3, 11, and 12, the display panel 110 includes 4×6 pixels, but not being limited thereto. In FIGS.

11 and 12, only 4×6 pixels in the display panel 110 are shown for convenience of illustration, and the number of pixels arranged in the display panel 110 may be determined based on a resolution thereof, e.g., one of 1920×1080, 2560×1440, and 3840×2160 according to resolution.

An image displayed on a first pixel PXa in a first sub frame SF11 in the first frame F1 moves to a third pixel PXc in a first sub frame SF21 in the second frame F2. An image displayed on the display panel 110 in the first sub frame SF11 in the first frame F1 moves by two pixels in the first direction D1 in the first sub frame SF21 in the second frame F2.

When the display panel 110 is driven through a column inversion method, a red sub pixel, a green sub pixel and a blue sub pixel in the first pixel PXa in the first sub frame SF11 are driven in positive polarity (+), negative polarity (−) and positive polarity (+), respectively, in the first frame F1 as shown in FIG. 11, and a red sub pixel, a green sub pixel, and a blue sub pixel in the second pixel PXc are driven in positive polarity (+), negative polarity (−) and positive polarity (+), respectively, in the first sub frame SF21 in the second frame F2 as shown in FIG. 12.

When an image displayed on the first pixel PXa in the first sub frame SF11 in the first frame F1 moves to the third pixel PXc in the first sub frame SF21 in the second frame F2, the same image signal may be repeatedly driven in positive polarity (+), negative polarity (−) and positive polarity (+) as shown in FIGS. 11 and 12. That is, even when the display panel 110 is driven through a column inversion method, an image displayed on the display panel 110 is displayed in a fixed polarity.

Figure 13:
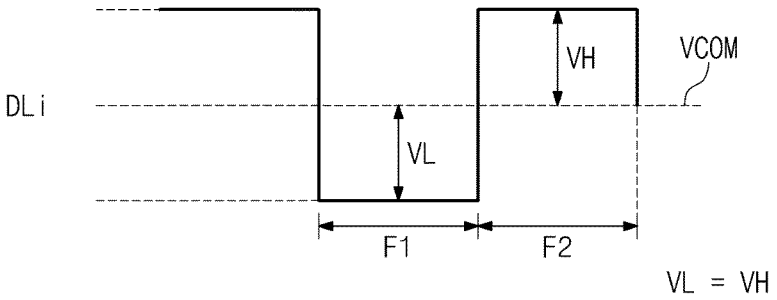
FIGS. 13 and 14 are views illustrating a data grayscale voltage provided to a predetermined data line.
Figure 14:
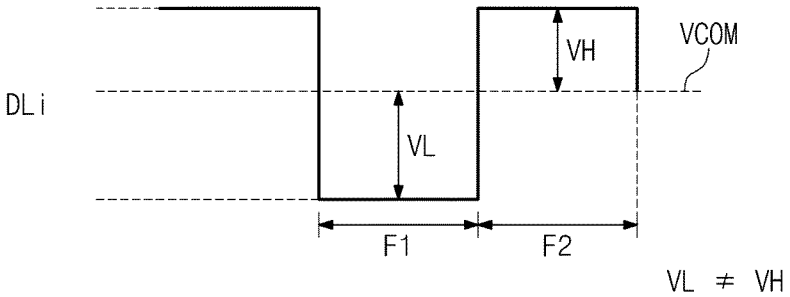

FIGS. 13 and 14 are views illustrating a data grayscale voltage provided to a predetermined data line.

Referring to FIGS. 13 and 14, when the display panel 110 of FIG. 1 is driven through a column inversion method, a grayscale voltage provided to a predetermined data line DLi may have different polarities based on common voltage VCOM. In an ideal case, as shown in FIG. 13, a difference VH between a grayscale voltage of a positive polarity (+) provided to the data line DLi and a common voltage VCOM is identical to a difference VL between a grayscale voltage of a negative polarity (−) and a common voltage VCOM (i.e., VH=VL).

However, due to a parasite capacitance between the gate electrode and the drain electrode of a switching transistor, a grayscale voltage applied to a liquid crystal capacitor may be distorted as shown in FIG. 14. Such a distorted voltage is called a kickback voltage. A grayscale voltage provided to an actual liquid crystal capacitor by kick-back voltage is biased to one of positive polarity (+) and negative polarity (−) based on the common voltage VCOM (i.e., VH≠VL).

When the display panel 110 is driven through a column inversion method, since the brightness sum of a red pixel, a green pixel and a blue pixel in one pixel PX of FIG. 2 is displayed as one color, a brightness change by kick-back voltage may not be recognized.

Figure 15:
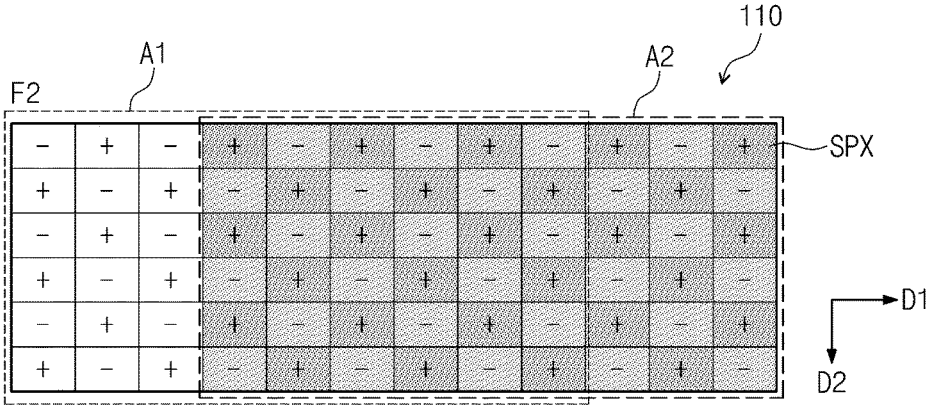
FIG. 15 is a view illustrating a distortion phenomenon of an image displayed on a display panel having a crossing structure of FIG. 2.

FIG. 15 is a view illustrating a distortion phenomenon of an image displayed on an exemplary embodiment of a display panel having the staggered structure of FIG. 2.

As described above with reference to FIGS. 4 and 5, when an image displayed on the display panel 110 in the first frame F1 moves by one pixel in the first direction D1 in the second frame F2, the same grayscale voltage is moved by one pixel and displayed in the same polarity.

As described above with reference to FIGS. 6 and 7, when an image displayed on the display panel 110 in the first sub frame SF11 in the first frame F1 moves by two pixels in the first direction D1 in the first sub frame SF21 in the second frame F2, the same grayscale voltage is moved by two pixels and displayed in the same polarity.

Referring to FIG. 15, when an image displayed on a second area A2 of the display panel 110 in the first frame F1 moves by one pixel in the first direction D1 and is displayed in the second frame F2, a brightness difference may occur as a check pattern in an image displayed on the second area A2 in the second frame F2 and may be recognized by a user.

Figure 16:
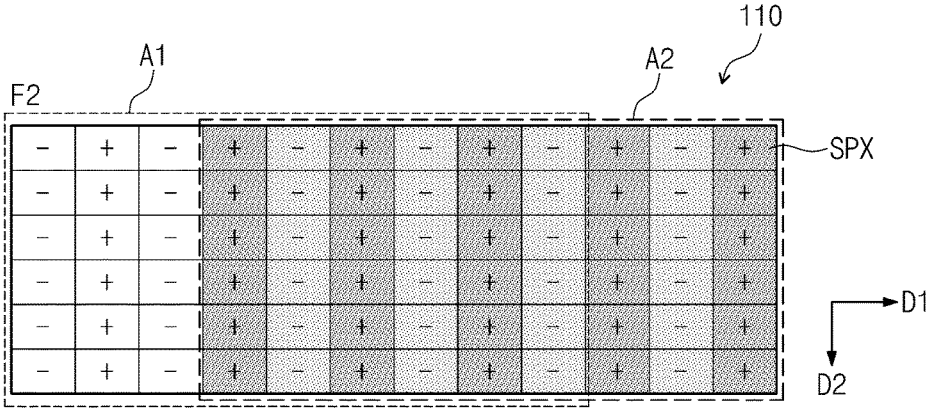
FIG. 16 is a view illustrating a distortion phenomenon of an image displayed on a display panel having a non-staggered structure of FIG. 8.

FIG. 16 is a view illustrating a distortion phenomenon of an image displayed on an exemplary embodiment of a display panel having the non-staggered structure of FIG. 8.

As described above with reference to FIGS. 9 and 10, when an image displayed on the display panel 110 in the first frame F1 moves by one pixel in the first direction D1 in the second frame F2, the same grayscale voltage is moved by one pixel and displayed in the same polarity.

As described above with reference to FIGS. 11 and 12, when an image displayed on the display panel 110 in the first sub frame SF11 in the first frame F1 moves by two pixels in the first direction D1 in the first sub frame SF21 in the second frame F2, the same grayscale voltage is moved by two pixels and displayed in the same polarity.

Referring to FIG. 16, when an image displayed on a second area A2 of the display panel 110 in the first frame F1 moves by one pixel in the first direction D1 and is displayed in the second frame F2, a brightness difference may occur as a check pattern in an image displayed on the second area A2 in the second frame F2 and may be recognized by a user.

Figure 17:
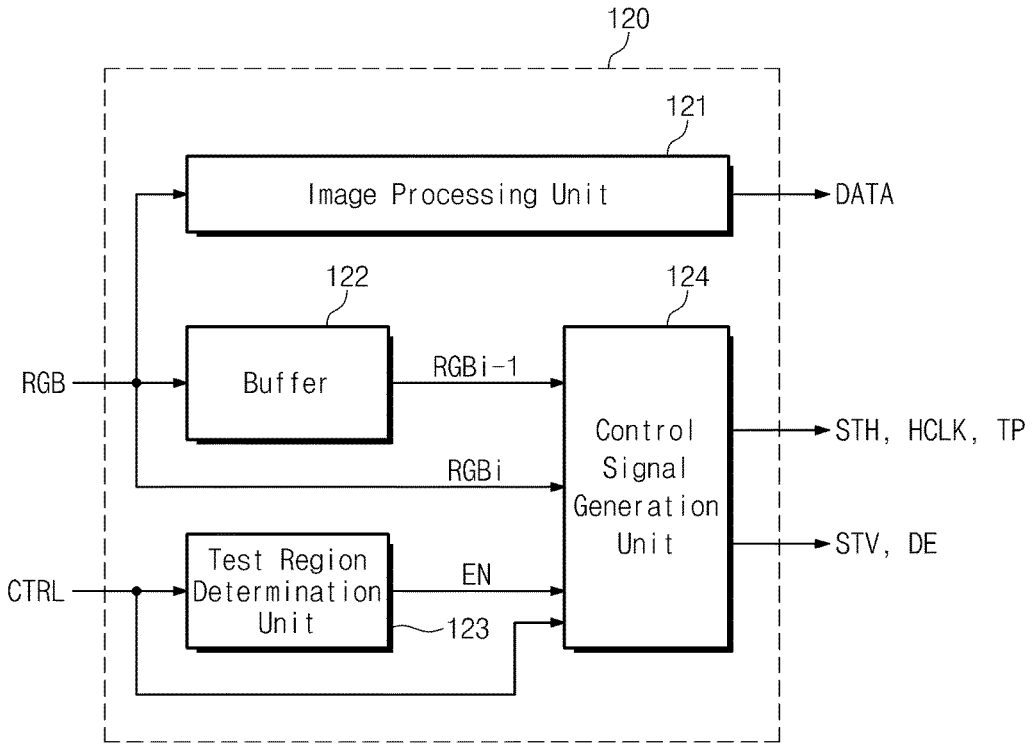
FIG. 17 is a block diagram illustrating an exemplary embodiment of a timing controller of FIG. 1, according to the invention.

FIG. 17 is a block diagram illustrating an exemplary embodiment of the timing controller of FIG. 1, according to the invention.

Referring to FIG. 17, an exemplary embodiment of the timing controller 120 includes an image processing unit 121, a buffer 122, a test region determination unit 123 and a control signal generation unit 124. The image processing unit 121 outputs a data signal DATA obtained by converting an image signal RGB to be a predetermined type corresponding to the display panel 110 of FIG. 1. The image processing unit 121 may perform a function such as dynamic capacitance compensation.

The buffer 122 stores the image signal RGB and provides an image signal RGBi-1 of a previous frame to the control signal generation unit 124. The test region determination unit 123 determines whether the image signal RGB is an image signal to be displayed on a test region of the display panel 110 in response to the control signal CTRL. When the image signal RGB is an image signal to be displayed on a test region of the display panel 110, an enable signal EN is activated to a predetermined level (for example, a high level).

The control signal generation unit 124 receives the image signal RGB as an image signal RGBi of a current frame and also receives the image signal RGBi-1 of the previous frame outputted from the buffer 122, the enable signal EN outputted from the test region determination unit 123 and the control signal CTRL. The control signal generation unit 124 generates a horizontal sync start signal STH, a clock signal HCLK, and a line latch signal TP to be provided to the data driver 140 of FIG. 1 and generates a vertical sync start signal STV and an output enable signal DE to be provided to the gate driver 130. The control signal generation unit 124 changes a frequency of the vertical sync start signal STV when the image signal RGBi of the current frame is identical to an image signal shifted from the image signal RGBi-1 of the previous frame in the first direction D1.

Figure 18:
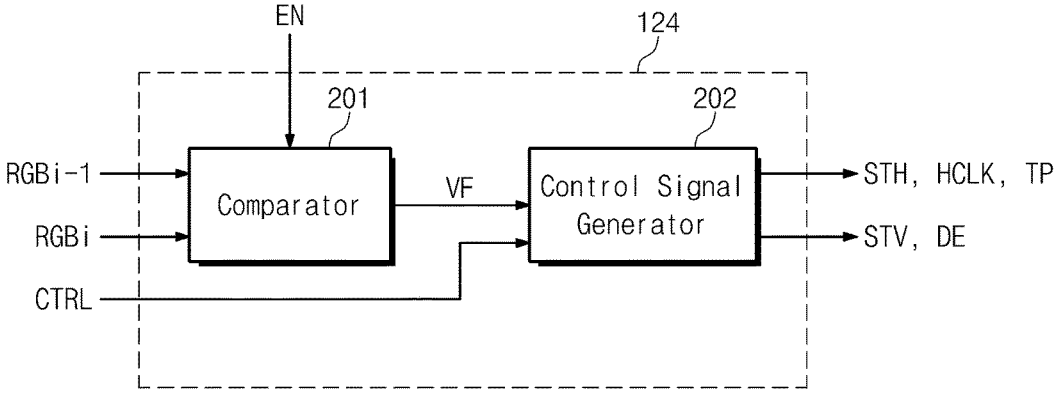
FIG. 18 is a block diagram illustrating an exemplary embodiment of a control signal generation unit of FIG. 17, according to the invention.

FIG. 18 is a block diagram illustrating an exemplary embodiment of the control signal generation unit of FIG. 17, according to the invention.

Referring to FIG. 18, an exemplary embodiment of the control signal generation unit 124 includes a comparator 201 and a control signal generator 202. The comparator 201 compares the image signal RGBi-1 of the previous frame with the image signal RGBi of the current frame in response to the enable signal EN and outputs a frequency change signal VF based on a comparison result.

In one exemplary embodiment, for example, when the image signal RGBi of the current frame is not identical to an image signal shifted from the image signal RGBi-1 of the previous frame in the first direction D1 while the enable signal EN is in a high level of active state, the frequency change signal VF in a first level (for example, a high level) is outputted. In such an embodiment, when the image signal RGBi of the current frame is identical to an image signal shifted from the image signal RGBi-1 of the previous frame in the first direction D1 while the enable signal EN is in a high level of active state, the frequency change signal VF in a second level (for example, a low level) is outputted. While the enable signal EN is in a low level as an inactive state, the frequency change signal VF is maintained in the high level.

The control signal generation unit 202 generates the horizontal sync start signal STH, the clock signal HCLK and the line latch signal TP to be provided to the data driver 140 of FIG. 1 based on the frequency change signal VF and the control signal CTRL, and generates the vertical sync start signal STV and the output enable signal DE to be provided to the gate driver 130 based on the frequency change signal VF and the control signal CTRL.

In such an embodiment, the control signal generator 202 outputs the vertical sync start signal STV in a normal frequency level while the frequency change signal VF is in the first level, and outputs the vertical sync start signal STV alternately in a change frequency level and a normal frequency level while the frequency change signal VF is in the second level.

Figure 19:
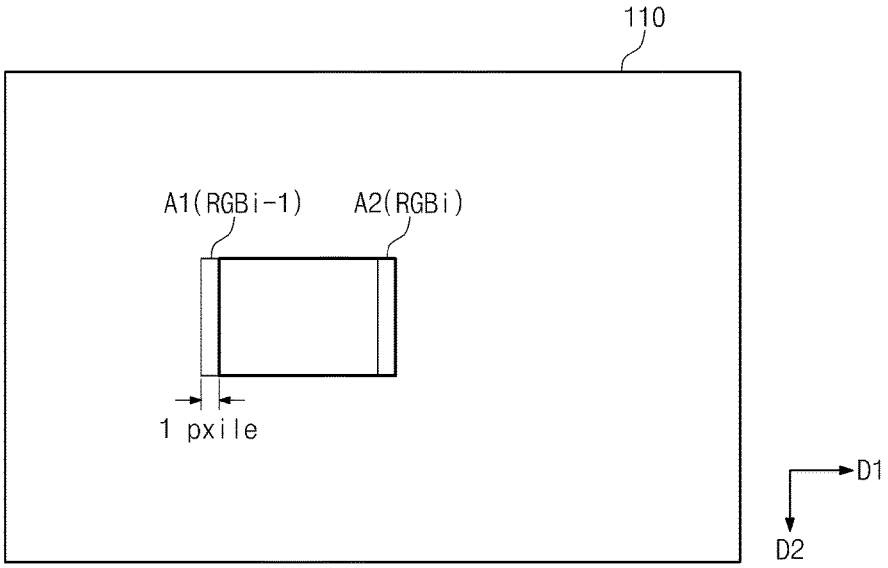
FIG. 19 is a view illustrating an exemplary embodiment of a test region of the display panel of FIG. 1.
Figure 20:
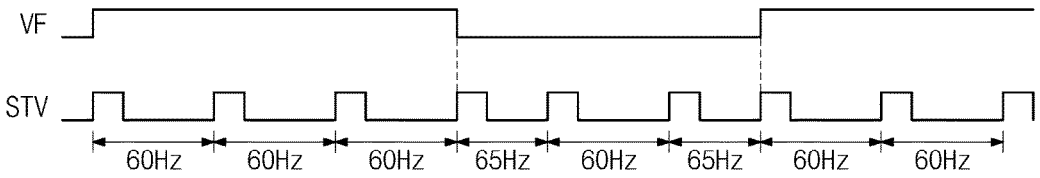
FIG. 20 is a timing diagram illustrating an exemplary embodiment of a frequency change signal outputted from a comparator of FIG. 18.

FIG. 19 is a view illustrating an exemplary embodiment of a test region of the display panel of FIG. 1. FIG. 20 is a timing diagram illustrating an exemplary embodiment of a frequency change signal VF outputted from the comparator of FIG. 18.

Referring to FIG. 19, in an exemplary embodiment, the test region may be set as a second region A2. In such an embodiment, when the image signal RGBi of the current frame is an image to be displayed on the second region A2 in a current frame (e.g., the first frame F1 of FIG. 3), the test region determination unit 123 outputs the enable signal EN in an active state.

The comparator 201 of FIG. 18 in the control signal generation unit 124 compares the image signal RGBi of the current frame with an image signal shifted from the image signal RGBi-1 of the previous frame in the first direction D1 in response to the enable signal EN. If the image signal RGBi of the current frame is not identical to the image signal shifted from the image signal RGBi-1 of the previous frame in the first direction D1, the comparator 201 outputs the frequency change signal VF in a high level. The control signal generator 202 generates the vertical sync start signal STV having a normal frequency level (for example, about 60 Hz) while the frequency change signal VF is in a high level. If the image signal RGBi of the current frame is identical to the image signal shifted from the image signal RGBi-1 of the previous frame in the first direction D1, the comparator 201 outputs the frequency change signal VF in a low level. The control signal generator 202 generates the vertical sync start signal STV, the frequency of which is changed alternately between a change frequency level (for example, about 65 Hz) and a normal frequency level (for example, about 60 Hz) while the frequency change signal VF is in a low level. A change frequency level may be set based on an optimal frequency level in which a brightness difference is not recognized and may be set to a frequency level higher or lower than the normal frequency level.

In an exemplary embodiment, the image signal RGBi-1 of the previous frame is an image signal displayed on a first region A1 and the image signal RGBi of the current frame is an image signal to be displayed on the second region A2 as described with reference to FIG. 19, but not being limited thereto. In an alternative exemplary embodiment, the image signal RGBi-1 of the previous frame may be an image signal to be displayed on the second region A2 and the image signal RGBi of the current frame may be an image signal to be displayed on the first region A1. In such an embodiment, a moving direction of the image signal RGB may be the first direction D1 or a reverse direction thereof and the comparator 201 outputs a low level of the frequency change signal VF. In an exemplary embodiment, the position and size of each of the first region A1 and the second region A2 may be variously modified based on characteristics of an image.

In an exemplary embodiment, the size of each of the first region A1 and the second region A2 used for a test region may be smaller than the entire size of the display panel 110, such that an amount of data used for comparison calculation of the control signal generation unit 124 is reduced.

Figure 21:
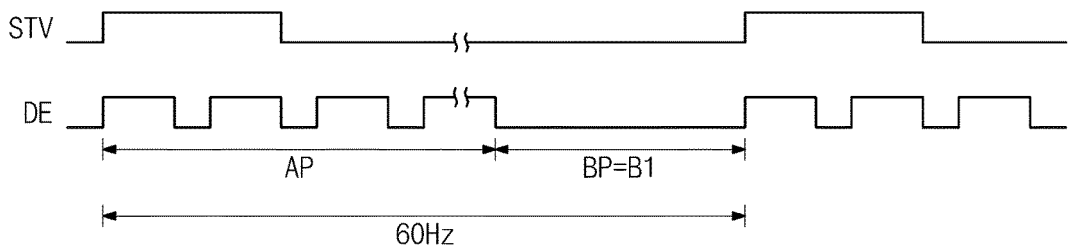
FIGS. 21 and 22 are timing diagrams of an exemplary embodiment of a vertical sync start signal and an output enable signal generated from a control signal generator of FIG. 18.
Figure 22:
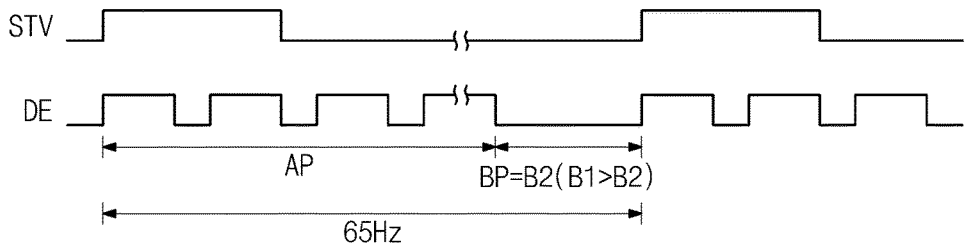

FIGS. 21 and 22 are timing diagrams of an exemplary embodiment of a vertical sync start signal and an output enable signal generated from the control signal generator of FIG. 18.

Referring to FIGS. 18 and 21, the control signal generator 202 generates the vertical sync start signal STV having a normal frequency level (for example, about 60 Hz) in response to the control signal CTRL while the frequency change signal VF is in a high level. The control signal generator 202 generates an output enable signal (also referred to as "data output signal") DE in synchronization with the vertical sync start signal STV.

Referring to FIGS. 18 and 22, the control signal generator 202 generates the vertical sync start signal STV, a frequency of which is changed alternately between a change frequency level (for example, about 65 Hz) and a normal frequency level (for example, about 60 Hz) in response to the control signal CTRL while the frequency change signal VF is in a low level. The control signal generator 202 generates a data enable signal DE in synchronization with the vertical sync start signal STV.

In an exemplary embodiment, as shown FIGS. 21 and 22, an active interval AP, during which the data signal DATA is provided to the display panel 110 of FIG. 1, in one frame may be constant regardless of a frequency of the vertical sync start signal STV. In an exemplary embodiment, a blank interval (BP=B1) in one frame while a frequency of the vertical sync start signal STV is about 60 Hz is longer than a blank interval (BP=B2) in one frame while a frequency of the vertical sync start signal STV is about 65 Hz (B1>B2). In an exemplary embodiment, as a frequency of the vertical sync start signal STV becomes higher, a blank interval becomes shorter. In such an embodiment, an active interval AP where the data signal DATA is provided to the display panel 110 of FIG. 1 in one frame does not change. Accordingly, in such an embodiment, when the frequency of the vertical sync start signal STV changes, the quality of a display image may not be deteriorated and brightness difference by kick-back voltage may not be recognized.

In an exemplary embodiment, where the vertical sync start signal STV is about 60 Hz, when the image signal RGBi of a current frame is identical to an image signal shifted from the image signal RGBi-1 of a previous frame in the first direction D1, a brightness difference by kick-back voltage may be recognized. In such an embodiment, a user does not recognize the brightness difference by changing a frequency of the vertical sync start signal STV alternately between about 65 Hz and about 60 Hz, e.g., repeatedly into about 65 Hz, about 60 Hz and about 65 Hz.

In an exemplary embodiment, where the vertical sync start signal STV is about 120 Hz, when the image signal RGBi of a current frame is identical to an image signal shifted from the image signal RGBi-1 of a previous frame in the first direction D1, a brightness difference by kick-back voltage may be recognized. In such an embodiment, a user does not recognize the brightness difference by changing a frequency of the vertical sync start signal STV alternately between about 130 Hz and about 120 Hz, e.g., repeatedly into about 130 Hz, about 120 Hz and about 130 Hz.

Figure 23:
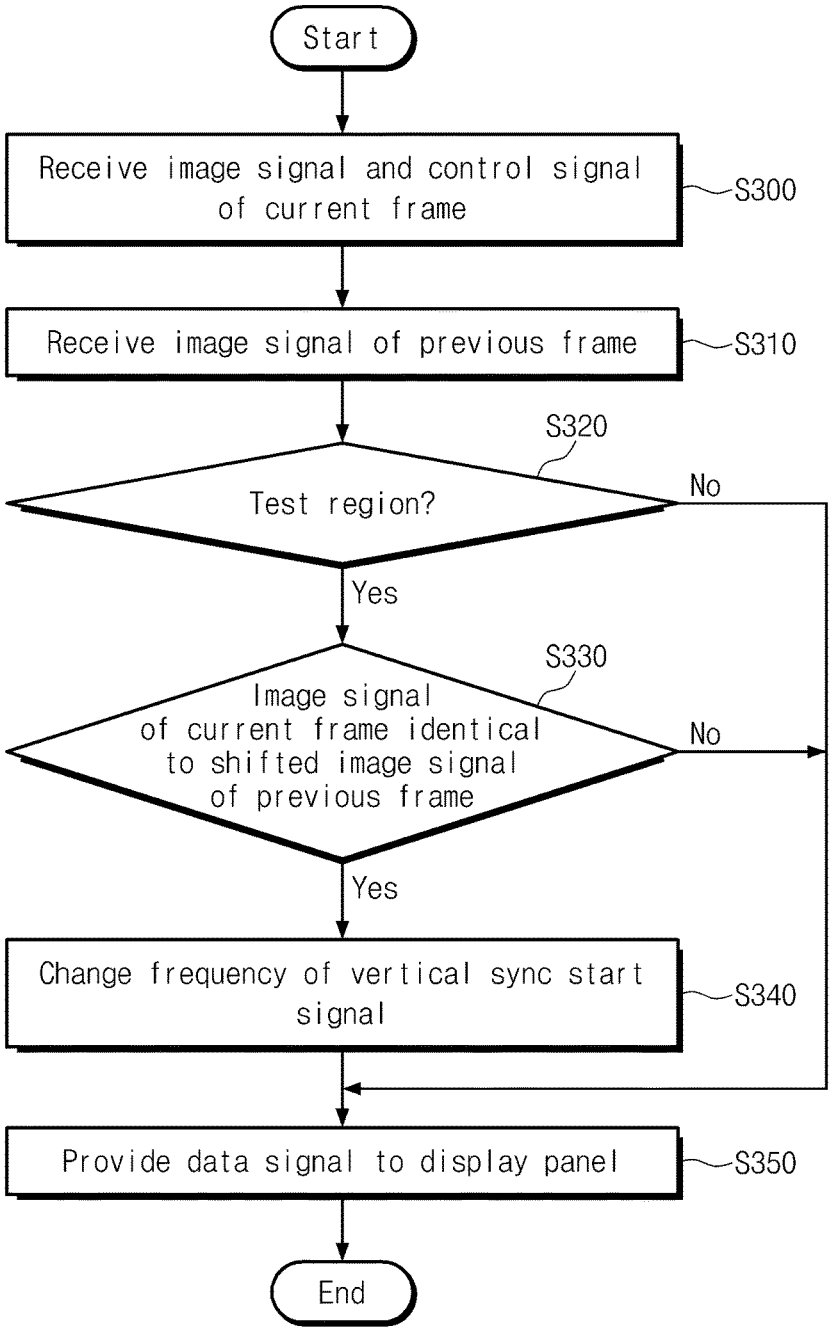
FIG. 23 is a flowchart illustrating an exemplary embodiment of a method of driving a display device, according to the invention.

FIG. 23 is a flowchart illustrating an exemplary embodiment of a method of driving a display device according to the invention. For convenience of description, an exemplary embodiment of a method of driving a display device will be described with reference to the timing controller of FIG. 16.

Referring to FIGS. 16 and 23, the timing controller 120 receives the image signal RGBi and the control signal CTRL of a current frame (S300). The control signal generation unit 124 receives the image signal RGBi-1 of a previous frame from the buffer 122 (S310).

The test region determination unit 123 determines whether the image signal RGBi of the current frame is an image signal to be displayed on the test region, e.g., the second region A2 of FIG. 19, in response to the control signal CTRL (S320).

If the image signal RGBi of the current frame is an image signal to be displayed on the test region A2, the control signal generation unit 124 determines whether the image signal RGBi of the current frame is identical to an image signal shifted the image signal RGBi-1 of the previous frame in the first direction D1 by a predetermined number of pixel(s) (S330).

When the image signal RGBi of the current frame is identical to the image signal shifted from the image signal RGBi-1 of the previous frame in the first direction D1 by the predetermined number of pixel(s), the control signal generation unit 124 changes a frequency of the vertical sync start signal STV (S340). The control signal generation unit 124 outputs the output enable signal DE in synchronization with the vertical sync start signal STV. The control signal generation unit 124 provides a horizontal sync start signal STH, a clock signal HCLK, and a line latch signal TP to the data driver 140 of FIG. 1 and provides a vertical sync start signal STV and the output enable signal DE to the gate driver 130 in response to the control signal CTRL.

The image processing unit 121 provides a data signal DATA obtained by performing image processing on the image signal RGB to the data driver 140 of FIG. 1.

In an exemplary embodiment of the display panel 110 shown in FIGS. 2 and 8, one pixel PX includes three sub pixels, that is, a red sub pixel, a green sub pixel and a blue sub pixel, for example. However, in an alternative exemplary embodiment, the display panel 110, one pixel PX may be realized in a super patterned vertical alignment ("SPVA") mode including six sub pixels, that is, two red sub pixels, two green sub pixels and two blue sub pixels, for example.

Such an embodiment of the method of driving a display device according to the invention may be applied to a display device including any type of an inversely driven display panel where a brightness difference between sub pixels occurs as an image moves by a predetermined number of pixel(s) in each frame.

According to exemplary embodiments of the invention, when an image signal of a current frame is identical to an image signal shifted from an image signal of a previous frame in a first direction, a brightness difference by kick-back voltage is effectively prevented from being recognized by changing a frequency of the vertical sync start signal.

The above-disclosed subject matter is to be considered illustrative, and not restrictive, and the appended claims are intended to cover all such modifications, enhancements, and other embodiments, which fall within the true spirit and scope of the invention. Thus, to the maximum extent allowed by law, the scope of the invention is to be determined by the broadest permissible interpretation of the following claims and their equivalents, and shall not be restricted or limited by the foregoing detailed description.

What is claimed is:

1. A display device comprising:

a display panel comprising a plurality of gate lines, a plurality of data lines crossing the plurality of gate lines, and a plurality of pixels connected to the plurality of data lines and the plurality of gate lines;

a data driver configured to drive the plurality of data lines;

a gate driver configured to drive the plurality of gate lines in synchronization with a vertical sync start signal; and a timing controller configured to control the data driver and the gate driver based on an image signal and a control signal inputted thereto from an outside, wherein the timing controller outputs the vertical sync start signal to the gate driver, and changes a frequency of the vertical sync start signal of a current frame when the image signal of the current frame is identical to an image signal shifted from the image signal of a previous frame in a first direction, and wherein the timing controller repeatedly changes the frequency of the vertical sync start signal between a change frequency level and a normal frequency level while it is determined that the image signal of the current frame is identical to the image signal shifted from the image signal of the previous frame in the first direction.

2. The display device of claim 1, wherein the timing controller further outputs a data enable signal to the gate driver in synchronization with the vertical sync start signal, and the data enable signal comprises an active interval and a blank interval.

3. The display device of claim 2, wherein the blank interval of the data enable signal is substantially inversely proportional to the frequency of the vertical sync start signal.

4. The display device of claim 2, wherein the timing controller further outputs a parallel sync start signal to the data driver in synchronization with the data enable signal.

5. The display device of claim 1, wherein the timing controller changes the frequency of the vertical sync start signal when the image signal of the current frame is an image shifted from the image signal of the previous frame by H pixel(s) in the first direction, wherein H is a positive integer.

6. The display device of claim 5, wherein when the frequency of the vertical sync start signal corresponding to the control signal is about 60 hertz, H is 1.

7. The display device of claim 5, wherein when the frequency of the vertical sync start signal corresponding to the control signal is about 120 hertz, H is 2.

8. The display device of claim 1, wherein the timing controller comprises:

an image processing unit configured to convert the image signal into a data signal which is applied to the data driver;

a buffer configured to store the image signal and to output the image signal of the previous frame;

a test region determination unit configured to receive the control signal, wherein the test region determination unit determines whether the image signal is an image signal to be displayed in a test region of the display panel, and outputs an enable signal based on a determination result; and a control signal generation unit configured to receive the image signal as the image signal of the current frame, wherein the control signal generation unit receives the image signal of the previous frame from the buffer, and outputs the vertical sync start signal based on the control signal and the enable signal.

9. The display device of claim 8, wherein the control signal generation unit comprises:

a comparator configured to compare the image signal of the current frame with the image signal shifted from the image signal of the previous frame in the first direction and to output a frequency change signal based on a comparison result; and a control signal generator configured to output the vertical sync start signal based on the frequency change signal and the control signal.

10. The display device of claim 9, wherein the control signal generation unit further outputs a data enable signal to the gate driver in synchronization with the vertical sync start signal, and the data enable signal comprises an active interval and a blank interval.

11. The display device of claim 10, wherein the blank interval of the data enable signal is substantially inversely proportional to the vertical sync start signal.

12. The display device of claim 11, wherein the control signal generation unit further outputs a parallel sync start signal to the data driver in synchronization with the data enable signal.

13. The display device of claim 10, wherein the control signal generation unit changes the frequency of the vertical sync start signal when the image signal of the current frame is an image shifted from the image signal of the previous frame by H pixel(s) in the first direction, wherein H is a positive integer.

14. The display device of claim 10, wherein when the frequency of the vertical sync start signal corresponding to the control signal is about 60 hertz, H is 1.

15. A method of driving a display device, the method comprising:

receiving an image signal of a current frame and a control signal by a timing controller of the display device;

storing an image signal of a previous frame in a buffer of the timing controller;

generating a vertical sync start signal from the timing controller based on the control signal;

changing a frequency of the vertical sync start signal of the current frame when the image signal of the current frame is identical to an image signal shifted from the image signal of the previous frame in a first direction; and providing a data signal corresponding to the image signal of the current frame to a display panel of the display device in synchronization with the vertical sync start signal, wherein the frequency of the vertical sync start signal is repeatedly changed between a change frequency level and a normal frequency level while it is determined that the image signal of the current frame is identical to the image signal shifted from the image signal of the previous frame in the first direction.

16. The method of claim 15, further comprising:

generating a data enable signal comprising an active interval and a blank interval in synchronization with the vertical sync start signal.

17. The method of claim 16, wherein the blank interval of the data enable signal is substantially inversely proportional to the frequency of the vertical sync start signal.

18. The method of claim 15, wherein the changing the frequency of the vertical sync start signal comprises changing the frequency of the vertical sync start signal when the image signal of the current frame is an image shifted from the image signal of the previous frame by H pixel(s) in the first direction, wherein H is a positive integer.

19. The method of claim 15, further comprising:

activating an enable signal when the image signal of the current frame is an image signal to be displayed in a test region of the display panel, wherein the changing the frequency of the vertical sync start signal is performed when the enable signal is in an active state.

* * * * *